United States Patent [19]

Hörner et al.

[11] 4,222,144

[45] Sep. 16, 1980

[54] BLOWING APPARATUS FOR REMOVING SOOT

[75] Inventors: Gerhard Hörner, Mannheim; Kurt Köhler, Beindersheim, both of Fed. Rep. of Germany

[73] Assignee: Bergemann GmbH, Wesel, Fed. Rep. of Germany

[21] Appl. No.: 972,226

[22] Filed: Dec. 22, 1978

[30] Foreign Application Priority Data

Dec. 24, 1977 [DE] Fed. Rep. of Germany ..... 2757981

[51] Int. Cl.[3] ..... F23J 3/02

[52] U.S. Cl. ..... 15/317

[58] Field of Search ..... 15/316 R, 316 A, 317, 15/318

[56] References Cited

U.S. PATENT DOCUMENTS

| | | | |
|---|---|---|---|
| 3,230,568 | 1/1966 | Saltz | 15/317 |
| 3,344,459 | 10/1967 | Jankowski | 15/317 |
| 3,585,673 | 6/1971 | Nelson et al. | 15/317 |

*Primary Examiner*—Christopher K. Moore
*Attorney, Agent, or Firm*—Max Fogiel

[57] ABSTRACT

A soot blower is provided with a lance which is axially and rotatable displaceable by means of a motor. A driving wheel for effecting the axial displacement is connected with a driving shaft through two free-wheel devices having entrainment members which act in opposite directions and lost motion in the rotational direction of the driving shaft is provided for in one of the free-wheel devices.

4 Claims, 4 Drawing Figures

Fig. 1
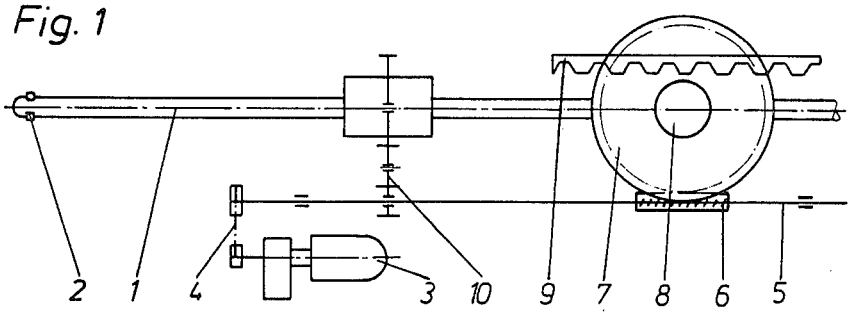
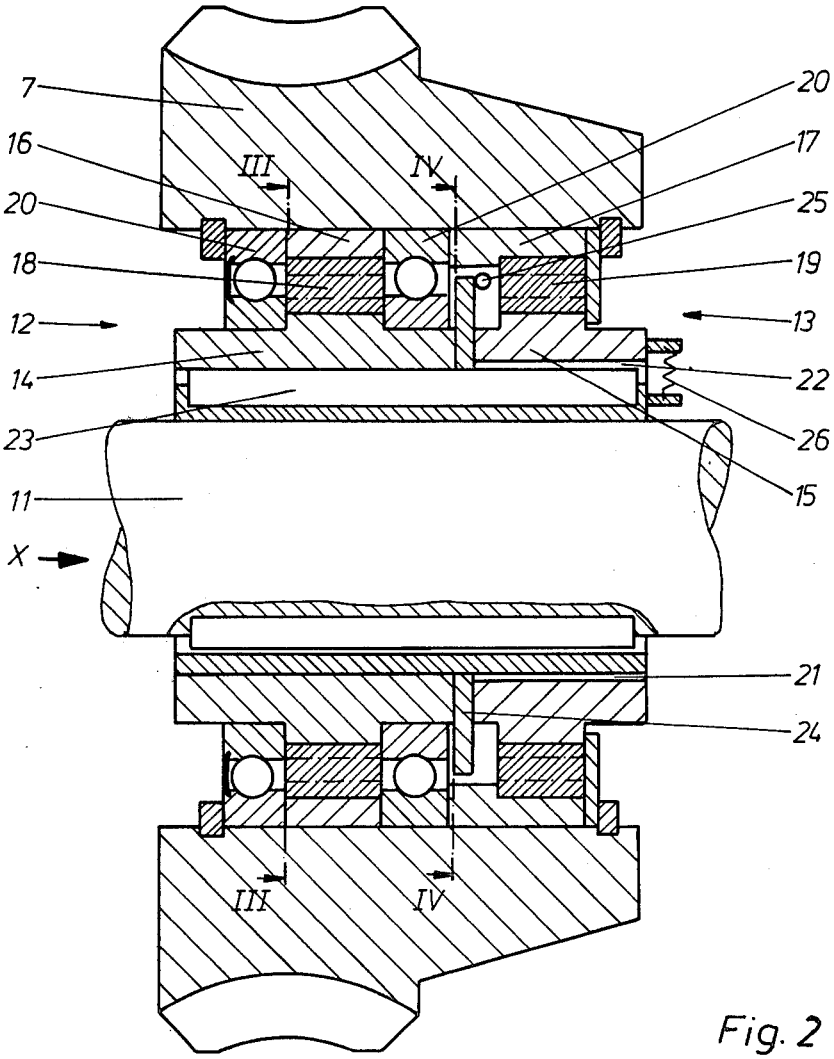
Fig. 2

BLOWING APPARATUS FOR REMOVING SOOT

BACKGROUND OF THE INVENTION

The present invention relates to a blowing apparatus for removing soot, comprising a tubular lance.

In known blowing apparatus comprising a lance, blast jets, which issue out of nozzles of the lance and serve for cleaning heating surfaces, describe helicoidal paths which always assume the same position in space. Hereby, there is a danger that the heating surface is engaged by the blast jet at the same place during each blasting operation. In particularly unfavourable circumstances, damage can occur through erosion by constantly repeated blasting.

It is an object of the present invention to provide a blowing apparatus in which the position of the blast jets in space and thereby also relative to the heating surfaces to be cleaned can be displaced during each blasting operation.

SUMMARY OF THE INVENTION

The point of departure for the present invention is a soot blower in accordance with U.S. Pat. No. 3,230,568. This patent shows and describes the functional relationship between motor, rotary drive, worm wheel, and tubular lance. What is new to this state of the art is the coupling between the worm wheel and the drive shaft. This coupling consists of two freewheels with opposing take along directions, whereby one free wheel exhibits play in the direction that the drive shaft turns.

The invention provides that the blasts that emerge from the jets during energy blasting procedure describe another helicoidal surface in space.

According to the present invention there is provided a blowing apparatus for removing soot, comprising, tubular lance means, motor means to provide power for axially and rotatably displacing said lance means, drive wheel means drivingly connected to said motor, drive shaft means drivingly connectable to said drive wheel means, first free wheel means connected between said drive wheel means and said drive shaft means to drivingly entrain said drive shaft means when said drive wheel means is driven in a given rotational sense, second free wheel means connected between said drive wheel means and said drive shaft means to drivingly entrain said drive shaft means when said drive wheel means is driven in a rotational sense opposite to said given rotational sense, lost motion connection means between said second free wheel means and said drive shaft means to provide a driving lag between said second free wheel means and said drive shaft means, and means coupling said drive shaft means with said tubular lance means to convert rotary motion of said drive shaft means to axial motion of said tubular lance means.

Said second free wheel means may comprise an inner annular member disposed around said drive shaft means to define a clearance therebetween, said inner annular member having surfaces defining an arcuate recess therein, and projection means extend from said drive shaft means into said recess to provide said lost motion connection means.

Said recess may have an arcuate length which is selectably variable.

An outer annular member may be disposed around said inner annular member, entraining means being disposed between said inner annular member and said outer annular member to rotatably entrain said inner annular member, first restoring spring means connecting said drive shaft means with said inner annular member to urge said entraining means away from an entraining position thereof, and second restoring spring means connecting said drive shaft means with said outer annular member.

BRIEF DESCRIPTION OF THE DRAWINGS

An embodiment of the present invention will now be more particularly described by way of example and with reference to the accompanying drawings in which:

FIG. 1 shows an apparatus embodying the present invention,

FIG. 2 shows a longitudinal section through a driving wheel of an apparatus embodying the present invention.

Figure 3:
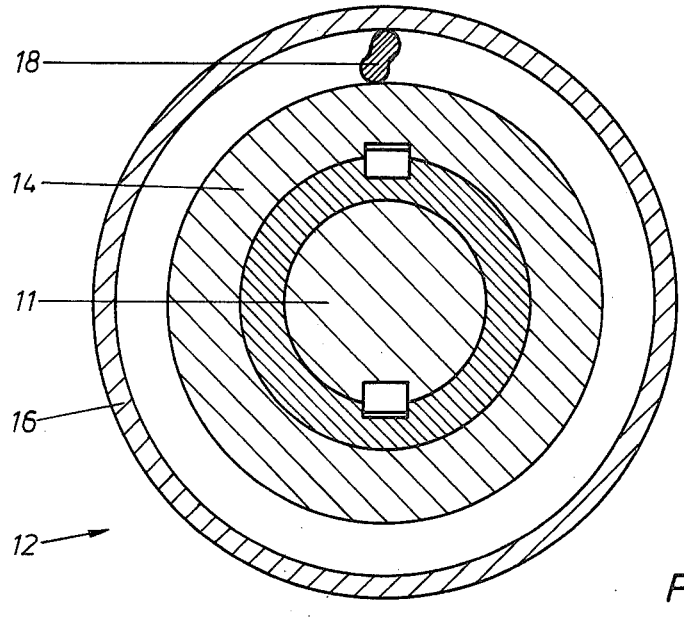
FIG. 3 shows a section along line III—III of FIG. 2.

A blowing apparatus for removing soot, embodying the present invention, will now be described with reference to a so-called lance-screw blower, in which axial displacement thereof, effected through a wheel, and rotary displacement thereof are taken off from the same shaft. The embodiment described below is applicable to blowing apparatus having blast jets which describe a helicoidal surface.

The apparatus shown in FIG. 1 comprises a tubular lance 1, which is mounted to be axially displaceable on a fixed travelling carrier (not shown). Blast nozzles 2, through which issues blasting medium introduced into the rear end of the lance 1 for cleaning of the heating surfaces, are provided at the front end of the lance 1.

A motor 3 delivers rotary motion through a chain drive 4 to a worm shaft 5, from which the axial motion and the rotary motion of the lance 1 are taken off. A worm 6 arranged on the worm shaft 5 drives a wheel 7 which acts as a driving wheel for the axial motion of the lance 1. The wheel 7 in the normal operation is connectable fast with a driving pinion 8. The driving pinion 8 engages a toothed rack 9, which is fixedly disposed on the travelling carrier and thus effects the axial motion of the lance 1 and the blast nozzles 2. The rotary motion of the worm shaft 5 is transferred through spur gearing 10 to a sleeve rotatably connected fast with the lance 1.

The wheel 7, shown enlarged in FIG. 2, is arranged together with the driving pinion 8 on a driving shaft 11 for the advance of the lance 1. The wheel 7 is connected through two free-wheel devices 12 and 13 with the driving shaft 11. The free-wheel devices 12 and 13 each contain tiltable clamping or entraining bodies 18 and 19 respectively between an inner ring 14 and 15 and an outer ring 16 and 17. The outer rings 16 and 17 are connected fast with the wheel 7.

Thus the lance is mounted to slide axially on a fixed support. On the support, there is a toothed rack 9 which is engaged by driving pinion 8. This driving pinion causes the lance to move axially. The worm wheel 7 and the driving pinion 8 are mounted on the drive shaft 11. Accordingly, when worm wheel 7 revolves, its rotation will be transferred through drive shaft 11 to driving pinion 8, which rests on one and the same shaft. For such operation, in this case, it is assumed that motor 3, chain drive 4, worm shaft 5, worm 6, worm wheel 7, drive shaft 11, and driving pinion 8 are mounted on one drive carriage, which is coupled to tubular lance 1, so that they participate in the axial motion of tubular lance 1.

The free-wheel device 12 by its inner ring 14 is connected fast with the driving shaft 11. The wheel 7 is guided by two ball bearings 20 on the inner ring 14. The driving shaft 11 can be actuated by the free-wheel device 12 only in an anti-clockwise direction as seen in direction X. In a clockwise direction, the wheel 7 is freely moveable relative to the driving shaft 11.

In the free-wheel device 13, the inner ring 15 is disposed with a clearance 21 on the driving shaft 11. The inner ring 15 has a groove 22, which extends by, for example, 15° in the rotational direction of the driving shaft 11.

A key 23 is disposed in the driving shaft 11 and engages into the groove 22. The driving shaft 11 can be actuated by the free-wheel device 13 in a clockwise direction as seen in direction X.

A washer 24 is provided between the two free-wheel devices 12 and 13 and is fastened free of play on the driving shaft 11. A first restoring spring 25 connects the washer 24 and thereby the driving shaft 11 with the outer cage of the free-wheel device 13. A second restoring spring 26 is provided between the driving shaft 11 and the inner ring 15 of the free-wheel device 13.

In this manner, the inner ring 15 can be varied by the restoring spring 26 and the outer cage by the restoring spring 25 relative to the driving shaft 11. The inner ring 15 has a rest position in which it is drawn by the restoring spring 26 against an idling stop, as shown in FIG. 4.

Figure 4:
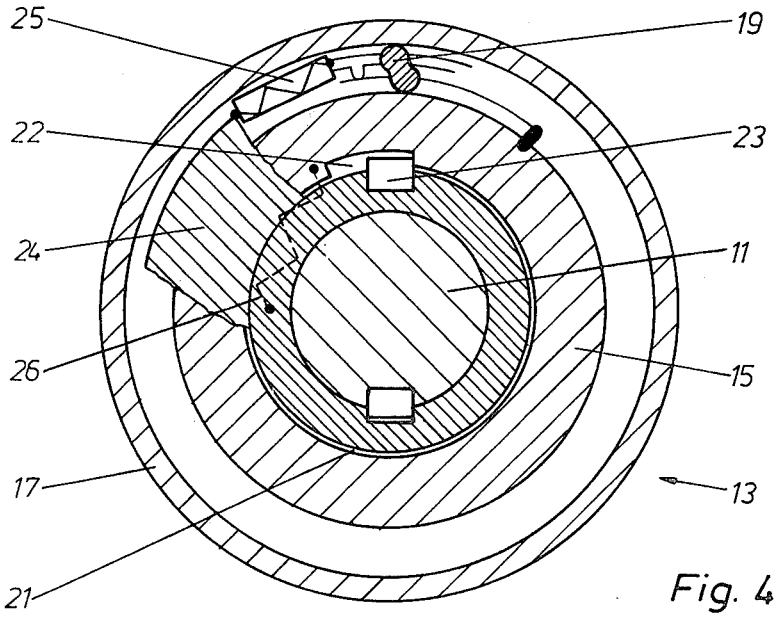
FIG. 4 shows a section along line IV—IV of FIG. 2.

The embodiment described above operates as follows:

In its rest position, the free-wheel device 13 is disposed as shown in FIG. 4. On switching-on the apparatus, the outer ring 17, which is connected fast with the wheel 7, is set into motion and via the clamping body 19 actuates the inner ring 15, which at first moves freely on the driving shaft 11. The drive shaft is set into rotation only after overcoming the play in the groove 22. During this delay, which is provided by the freely selectable arcuate length of the groove, the lance 1 with the blast nozzles 2 turns through a certain angle about its longitudinal axis in correspondence with the transmission ratios of the spur gearing 10. At the same time, the restoring springs 25 and 26 are tensioned. During the first phase of the blasting operation, the driving forces for the forward movement of the lance act on the driving shaft 11 via the outer ring 17, the clamping bodies 19, the inner ring 15 and the key 23. The free-wheel device 12 idles.

At the start of blasting, the lance 1 fills with blasting medium. Under the effect of the pressure of the blasting medium, the lance 1 automatically moves forward, the effective force provided by the motor 3 on the free-wheel device 13 decreases and the clamping effect of the clamping body 19 is cancelled, so that the restoring spring 25 can draw the outer cage and the restoring spring 26 the inner ring 15 back to the idling position. In this instance, the fixed connection between the driving shaft 11 and the wheel 7 is produced by the free-wheel device 12, by which it is retained for the further advance and the entire return to the initial setting. Since the free-wheel device 13 was already drawn back against the idling stop on attainment of the setting at the start of blasting, it is ready for the next blasting process on reaching its rest position.

In summary, restoring spring 25 is supposed to restore the outer cage (outer ring 7) and restoring spring 26 to restore inner ring 15 to idling position. Washer 24 is not free, but is fastened without play and thus is fixed on drive shaft 11. This means that drive shaft 11 is coupled to washer 24, which is coupled immovably to it, and that restoring spring 25 is coupled to outer ring 17. As already noted, the position of inner ring 15 and of the outer cage is changed in relation to drive shaft 11. As a result, inner ring 15 is not changed. After the steam is turned on the steam drives tubular lance 1 forwardly. Worm 6, which is driven through the motor and which is selflocking, and worm wheel 7 break this motion and drive the tubular lance at a controlled velocity. In the opposite direction the motor must restore the lance in opposition to the pressure of the steam.

In further summarizing the operation of the present invention, the lance is at first in a position in which it is protected from the hot flue gases. When the motor is switched on the lance is brought from this rest position into the current of flue gas from the boiler. During this process the steam has not yet been turned on. The free wheel 13 is at first in the position shown in FIG. 4. When the motor is switched on, outer ring 17, which is fixed to worm wheel 7, is brought into motion and activates inner ring 15 through clamping bodies 19, with inner ring 15 at first revolving free on drive shaft 11. Drive shaft 11 is not made to revolve until the play in the widened groove is overcome. During this delay, which results from the breadth of the groove, tubular lance 1 has, along with blast nozzles 2, already revolved through a specific angle around its longitudinal axis, an angle that corresponds to the transmission ratios of spur gear 10. Without, therefore, the lance having moved axially (because of the play in groove 22 of free wheel 13), it has already revolved around a specific angle. Thus, there exists during this initial phase no strict relation between the lance's axial and revolving motions. The blasts that emerge from the jets 2 of tubular lance 1, therefore, will describe another helicoidal surface in space after each blasting operation. This means that every point on the heated surface will be reached by the blast rays during the various blast operations. The risk of damage to the heated surfaces that can result from erosion when they are repeatedly and continuously blown on, is thus counteracted.

If the play in groove 22 is overcome, restoring springs 25 and 26 are released. The forces of forward movement are transferred in this first phase of blasting to drive shaft 11 by free wheel 13 through outer ring 17, clamping bodies 19, and outer ring 15 by means of key 23. Free wheel 12 runs along free.

In the blasting-commencement position the tubular lance fills with steam. Tubular lance 1 moves forward independently under the action of steam pressure as explained above. This causes the dynamic effect of motor 3 to escape to free wheel 13, and the clamping effect is cancelled, so that restoring spring 25 can restore the outer cage and restoring spring 26 can restore the inner ring to the idling position. Free wheel 13 remains in this idling position until the lance reaches its rest position again.

The force exerted on tubular lance 1 by steam pressure produces, through toothed rack 9 and driving pinion 8, a secure coupling between drive shaft 11 and worm wheel 7 through free wheel 12. Free wheel 12 holds tubular lance 1 securely against the force of the steam pressure and permits only a controlled forward motion of tubular lance 1. As tubular lance 1 is being restored, the force of the motor is transferred through free wheel 12.

While a fixed association between the axial and the rotary motion of the lance exists in the known blowing apparatus, this association is releasable and adjustable in the driving wheel in the case of the embodiment described above by way of example. From this, a different association between axial and radial position of the nozzles is provided for each blasting operation.

We claim:

1. A blowing apparatus for removing soot, comprising:

(a) tubular lance means for discharging a pressurized blowing medium against surfaces to be cleaned, (b) motor means to provide power for axially and rotatably displacing said lance means, (c) drive wheel means drivingly connected to said motor, (d) drive shaft means drivingly connectable to said drive wheel means, (e) first free wheel means connected between said drive wheel means and said drive shaft means to drivingly entrain said drive shaft means when said drive wheel means is driven in a given rotational sense, (f) second free wheel means connected between said drive wheel means and said drive shaft means to drivingly entrain said drive shaft means when said drive wheel means is driven in a rotational sense opposite to said given rotational sense, (g) lost motion connection means between said second free wheel means and said drive shaft means to provide a driving lag between said second free wheel means and said drive shaft means, and (h) rotary motion of said drive shaft means being converted to axial motion of said tubular lance means.

2. An apparatus as defined in claim 1, wherein said second free wheel means comprises an inner annular member disposed around said drive shaft means to define a clearance therebetween, said inner annular member having surfaces defining an arcuate recess therein, and projection means extend from said drive shaft means into said recess to provide said lost motion connection means.

3. An apparatus as defined in claim 2, wherein said recess of the inner annular member of said second free wheel means has a freely selectable arcuate length.

4. An apparatus as defined in claim 2, wherein said second free wheel means has an outer annular member surrounding said inner annular member, entraining means being disposed between said inner annular member and said outer annular member to rotatably entrain said inner annular member, first restoring spring means connecting said drive shaft means with said inner annular member to urge said entraining means away from an entraining position thereof, and second restoring spring means connecting said drive shaft means with said outer annular member.

* * * * *